US007021479B2

(12) United States Patent
Pedmo et al.

(10) Patent No.: US 7,021,479 B2
(45) Date of Patent: Apr. 4, 2006

(54) PLASTIC CONTAINER WITH SIDEWALL VACUUM PANELS

(75) Inventors: Marc A. Pedmo, Brunswick, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 10/937,666

(22) Filed: Sep. 9, 2004

(65) Prior Publication Data

US 2005/0269284 A1 Dec. 8, 2005

Related U.S. Application Data

(63) Continuation-in-part of application No. 29/206,904, filed on Jun. 4, 2004, now Pat. No. Des. 504,617.

(51) Int. Cl.
*B65D 1/02* (2006.01)
*B65D 1/46* (2006.01)

(52) U.S. Cl. ..... 215/381; 215/379; 215/382; 215/383; 220/672; 220/675

(58) Field of Classification Search ..... 215/381, 215/383, 379, 384; 220/666, 672, 673, 669, 220/675

See application file for complete search history.

(56) References Cited

U.S. PATENT DOCUMENTS

| | | | | |
|---|---|---|---|---|
| 4,497,855 | A * | 2/1985 | Agrawal et al. | 428/36.92 |
| 5,054,632 | A * | 10/1991 | Alberghini et al. | 215/381 |
| 5,279,433 | A * | 1/1994 | Krishnakumar et al. | 215/381 |
| 5,690,244 | A * | 11/1997 | Darr | 215/382 |
| D396,810 | S * | 8/1998 | Riffer | D9/553 |
| 6,016,932 | A * | 1/2000 | Gaydosh et al. | 215/382 |
| 6,036,037 | A * | 3/2000 | Scheffer et al. | 215/381 |
| 6,065,624 | A * | 5/2000 | Steinke | 215/383 |
| 6,575,320 | B1 * | 6/2003 | Ota et al. | 215/381 |
| 2005/0035084 | A1 * | 2/2005 | Simpson et al. | 215/396 |

FOREIGN PATENT DOCUMENTS

WO W) 97/34808 * 9/1997

* cited by examiner

*Primary Examiner*—Sue A. Weaver
(74) *Attorney, Agent, or Firm*—Robert H. Backman

(57) ABSTRACT

The hollow plastic container includes a side wall with at least three inwardly depressed channels spaced from each other and extending around the side wall, with an upper channel, a central channel and a lower channel. At least two spaced apart vacuum panels are positioned between the upper and central channel, and at least two spaced apart vacuum panels are positioned between the central channel and lower channel.

17 Claims, 2 Drawing Sheets

PLASTIC CONTAINER WITH SIDEWALL VACUUM PANELS

CROSS-REFERENCE TO RELATED APPLICATIONS

This application is a continuation-in-part of U.S. Pat. application Ser. No. 29/206,904, filed Jun. 4, 2004 U.S. Pat. No. D 504,617.

BACKGROUND OF THE INVENTION

The present invention relates to an improved hot fillable plastic container.

The packaging of certain liquids requires that they be packaged while hot. During filling the container is subjected to elevated temperatures, the container is capped and as the product cools a negative internal pressure or hot fill vacuum is formed within the container. The container construction for a plastic container must be able to withstand such internal pressure changes while maintaining the container configuration.

Various constructions have been proposed for plastic containers in an effort to maintain the integrity of the container during hot fill operations. Thus, the hot fill containers have been produced with a generally cylindrical main body which is provided with a plurality of elongated vertically oriented panels. These panels, which are commonly referred to as pressure or vacuum panels, are designed to collapse inwardly after the container has been filled with a hot liquid so as to accommodate the inevitable volume shrinkage of the liquid in the container as the liquid cools. However, the inward flexing of the panels caused by the hot fill vacuum creates high stress points at the top and bottom edges of the pressure panels, and especially at the upper and lower corners of the panels. These stress points weaken the portions of the side wall near the edges of the panels, allowing the side wall to collapse inwardly during handling of the container or when containers are stacked together.

Numerous design changes have been proposed to overcome this problem, including but not limited to design variations in the vacuum panels, axially extending posts between the vacuum panels and circumferential ridges above and below the vacuum panels. However, despite these numerous designs it has been found that collapse under vacuum still occurs, especially in localized areas.

It is, therefore, a principal objective of the present invention to provide an improved design for a hot fillable plastic container that resists vacuum collapse.

It is a further objective of the present invention to provide an improved hot fillable plastic container as aforesaid which has an aesthetically pleasing design and is cost effective.

It is a further objective of the present invention to provide an improved plastic container as aforesaid which maintains its structural rigidity under hot fill conditions in a simple design which is readily prepared on a commercial scale.

Further objects and advantages of the present invention will appear hereinbelow.

SUMMARY OF THE INVENTION

In accordance with the present invention the foregoing objects and advantages are readily obtained.

The plastic container of the present invention comprises: a hollow body of plastic material having a lower supporting base, a side wall extending upwardly from the lower base, and an upper portion extending upwardly from the side wall, said upper portion including at least one opening therein; at least three inwardly depressed channels spaced from each other extending around the side wall, with a first of said channels being an upper channel, a second of said channels being a central channel, and a third of said channels being a lower channel; at least two spaced apart vacuum panels between the first and second channels, and at least two spaced apart vacuum panels between the second and third channels.

The container is desirably a hot fill container. Preferably, a plurality of the vacuum panels are provided between the first and second channels spaced from each other, and a plurality of the vacuum panels are provided between the second and third channels spaced from each other.

Further features of the present invention will appear hereinbelow.

BRIEF DESCRIPTION OF THE DRAWINGS

The present invention will be more readily understandable from a consideration of the accompanying drawings, wherein.

DETAILED DESCRIPTION OF PREFERRED EMBODIMENTS

Figure 1:
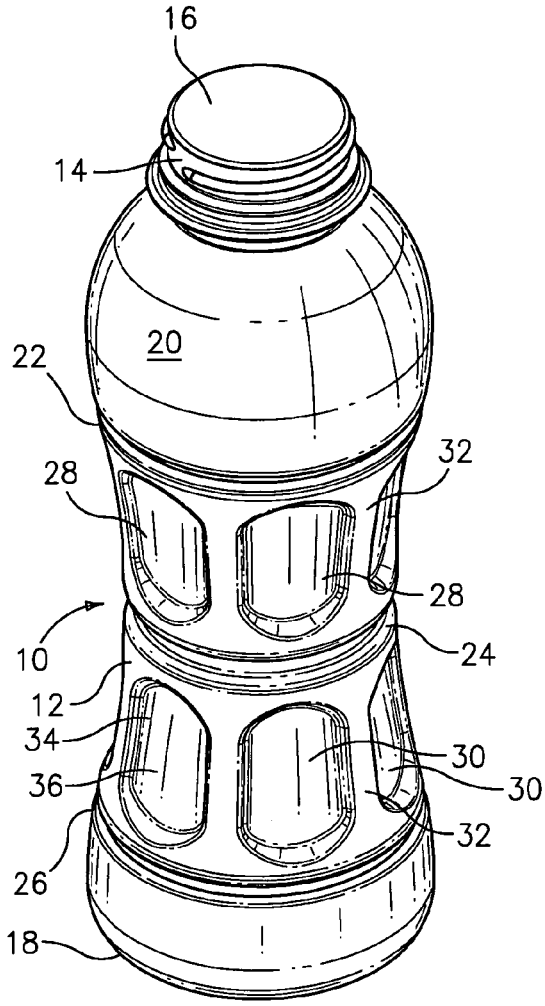
FIG. 1 is a perspective view of one embodiment of the container of the present invention showing the front and sides thereof.
Figure 4:
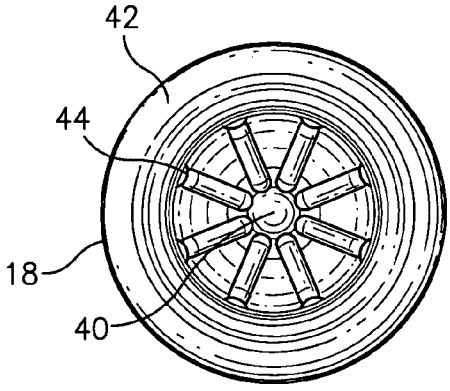
FIG. 4 is a bottom view of the container of FIG. 1.

Referring to the drawings, the container 10 of the present invention shown in FIG. 1 includes a side wall portion 12, an upper end 14 with a dispensing opening 16 therein, which may be threaded as shown, suitable for receiving a closure (not shown), and a base portion 18. A generally dome shaped portion 20 is located between the side wall portion 12 and the upper end 14.

Container 10 is a hot-fill, blow molded plastic container which is particularly suited to be filled with a liquid at an elevated temperature and subsequently sealed. As the liquid cools its volume decreases in the sealed container. The container is produced from a thermoplastic material, as polyethylene terephthalate (PET), high density polyethylene (HDPE), polyethylene naphthalate, polyvinyl chloride, and others.

The dome shaped portion 20 may if desired include a logo or trademark or the like thereon, and may also if desired include one or more pressure relief formations in addition or instead of a logo or trademark.

In accordance with the present invention the container side wall 12 includes a first or upper inwardly depressed channel 22, a second or central inwardly depressed channel 24, and a third or lower inwardly depressed channel 26. The inwardly depressed channels extend around the circumference of the container and preferably continuously circumscribe the side wall 12. Upper channel 22, central channel 24 and lower channel 26 are spaced from each other as clearly shown in the drawings.

Depending on the size and configuration of the container one may include greater than three inwardly depressed channels.

The side wall 12 also includes a plurality spaced apart vacuum panels, with at least two upper vacuum panels 28 disposed between the first channel 22 and second channel 24 and at least two spaced apart lower vacuum panels 30 disposed between the second channel 24 and third channel 26. In a preferred embodiment six of the spaced apart vacuum panels are disposed between the first and second channels and six of the spaced apart vacuum panels are disposed between the second and third channels as shown.

The vacuum panels are vertically elongated and are spaced apart from each other by smooth, vertically elongated land areas 32. In addition, each panel preferably includes a radially inwardly offset peripheral portion 34 and a central portion 36. In the preferred embodiment the vacuum panels are curved and the peripheral portion 34 includes a curved surface that is depressed further than the central portion 36. This construction of the vacuum panels plus channels allows for the container to maintain structural integrity as the vacuum is applied from the change in density of the product as it cools from the initial hot fill.

Base 18 desirably includes an inwardly extending central portion 40, a peripheral rim 42 to support the container when standing, and radially extending, outwardly disposed spokes or struts 44 extending between the central portion and peripheral rim. This base construction is particularly advantageous, although different base configurations can be used. Preferably, 6 to 10 of the spokes or struts are provided, and they are preferably uniformly spaced around the central portion of the base.

In accordance with the present invention the inwardly depressed channels or ribs in combination with the vacuum panels located therebetween provide structural stability. The panel construction allows the central panel portion 36 to flex inwardly as the bottle cools from the initial hot fill of the container. The channels or ribs provide the structural stability to maintain the desired shape of the container, whether the container be round as shown in the drawings, or square, rectangular or oval, under heat set conditions and to support the vacuum panels 28, 30 while they flex inwardly. Thus, the combination of channels or ribs plus vacuum panels as described provides a considerable advantage.

Figure 5:
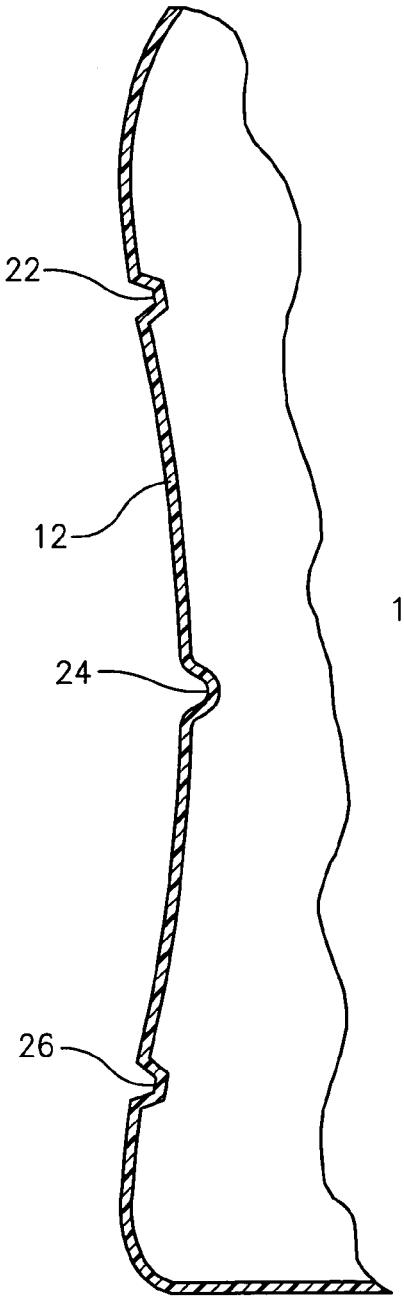
FIG. 5 is a partial sectional view of the container of FIG. 1 showing the spaced apart upper, central and lower channels.

Although the shape of the channels or ribs may vary, it is preferred that the central channel 24 have a semi-cylindrical cross-section as shown in FIG. 5, while the upper channel 22 and lower channel 26 have a semi-hexagonal cross-section as also shown in FIG. 5. The diameter of the channels may vary, but in the preferred embodiment the diameter of the central channel is larger than the diameter of the upper and lower channels. This is preferred to allow the central channel to hold more plastic during the blow molding process and thus increase the hoop strength of the central channel.

The container of the present invention is preferably a blow molded container, and a round container is preferred although other shapes can be used.

Figure 3:
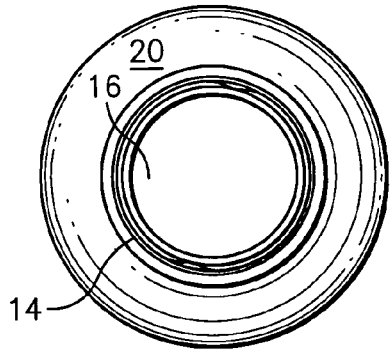
FIG. 3 is a top view of the container of FIG. 1.
Figure 2:
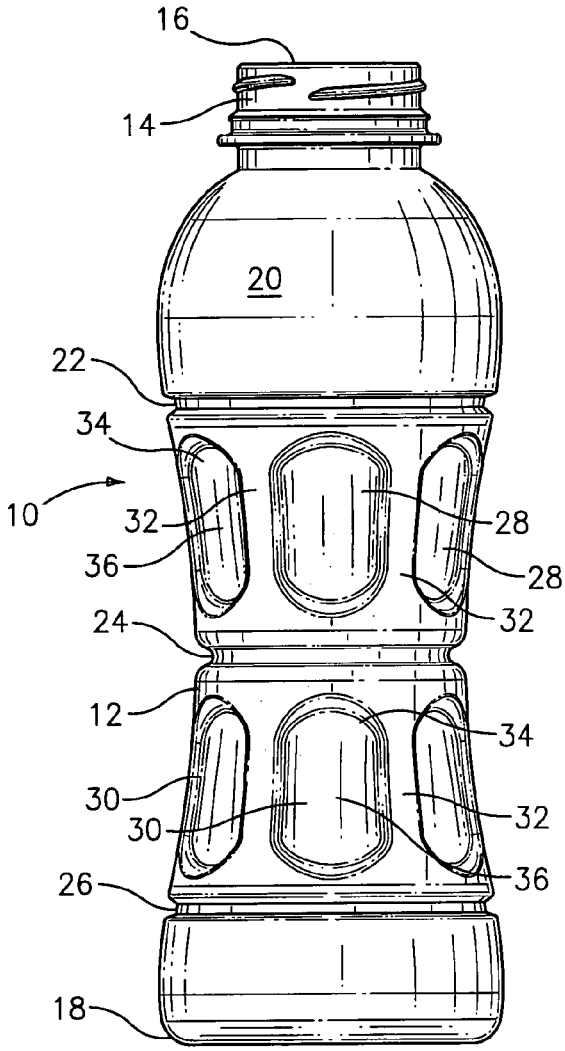
FIG. 2 is a rear view of the container of FIG. 1 showing the rear thereof.
Figure 6:
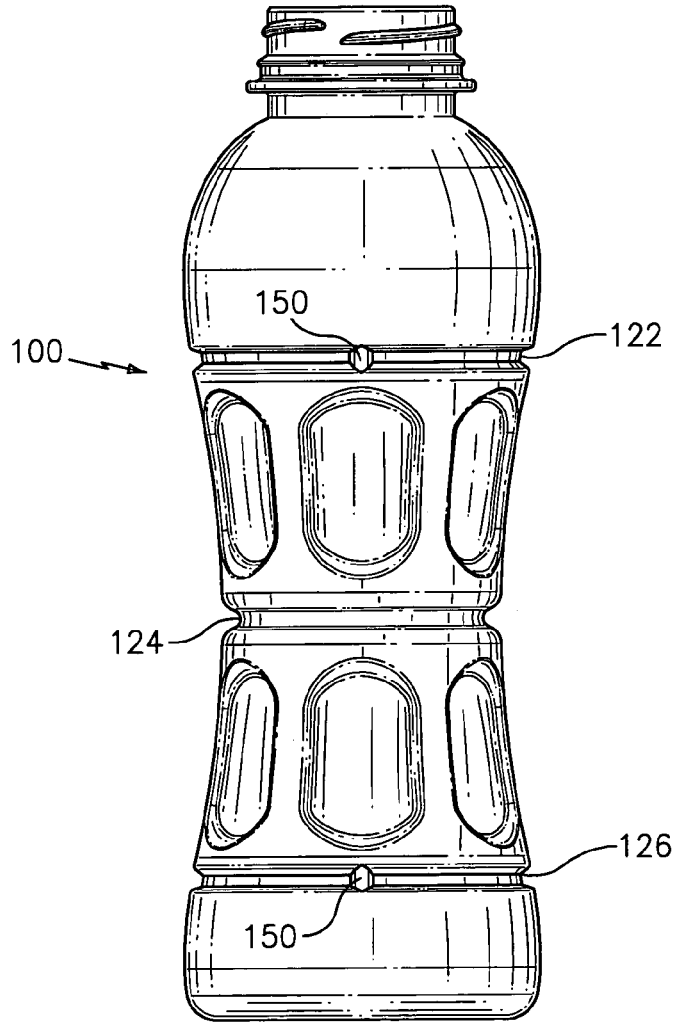
FIG. 6 is a rear view of an alternate embodiment of the container of the present invention.

The channels for ribs are preferably continuous as shown in FIGS. 1 and 2. However, if desired the ribs may be provided with at least two spaced apart discontinuities as shown in FIG. 6. Central channel 124 in container 100 is continuous, while upper channel 122 and lower channel 126 each have discontinuities 150. The discontinuities are raised portions which interrupt the continuity of the upper and lower ribs and separate them into two separate, discontinuous bands. The discontinuities are desirably located over the central portion of a vacuum band as clearly shown in FIG. 6. Greater than two discontinuities, for each of the upper and lower channels may be used separating these channels into more than two separate discontinuous bands, as for example, four or six discontinuities. If greater than two discontinuities are provided each should preferably be located over the central portion of a vacuum panel. Also, discontinuities may if desired by used in the central channel.

In accordance with the present invention the construction provides greater support and makes containers desirably rigid in a hot fill situation, particularly when the container includes a parting line. Moreover, the construction of the present invention advantageously provides more uniform flexing in the vacuum panels in a hot fill situation.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hollow plastic container, which comprises:

a hollow body of plastic material having a lower supporting base, a side wall extending upwardly from the lower base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel, and wherein said channels completely and continuously circumscribe the side wall; and two to six spaced apart vacuum panels between the first and second channels spaced apart from each other, and two to six spaced apart vacuum panels between the second and third channels spaced apart from each other, wherein each vacuum panel includes an inwardly offset peripheral portion and a central portion, and wherein said container is a hot fill container.

2. A container according to claim 1, wherein said container is a blow molded plastic container.

3. A container according to claim 1, wherein said panels are centered between respective channels.

4. A container according to claim 1, including elongated posts between the vacuum panels.

5. A container according to claim 4, wherein said vacuum panels are adjacent said depressed channels, are vertically elongated and spaced apart from each other by said elongated posts which are smooth, vertically elongated land areas.

6. A container according to claim 1, including an inwardly extending central portion of the base, a peripheral base rim to support the container when standing, and radially extending, outwardly disposed spokes extending between the central portion of the base and the peripheral rim.

7. A container according to claim 1, wherein said plastic material is polyethylene terephthalate.

8. A container according to claim 1, wherein the first and third of said channels each include at least two spaced apart discontinuities comprising raised portions, each of which interrupts the continuity of said first and third channels.

9. A container according to claim 8, wherein each discontinuity is located over the central portion of a vacuum panel.

10. A container according to claim 1, including a single first channel, a single second channel, and a single third channel.

11. A container according to claim 1, wherein the vacuum panels are curved and the peripheral portion includes a curved surface that is depressed further than the central portion.

12. A hollow plastic container which comprises:

a hollow body of plastic material having a lower supporting base, a side wall extending upwardly from the lower base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel, wherein said first and third channels have a semi-hexagonal cross-section and said second channel has a semi-cylindrical cross-section; and at least two spaced apart vacuum panels between the first and second channels, and at least two spaced apart vacuum panels between the second and third channels.

13. A hollow plastic container, which comprises:

a hollow body of plastic material having a lower supporting base, a side wall extending upwardly from the lower base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel; and two to six spaced apart vacuum panels between the first and second channels spaced apart from each other, and two to six spaced apart vacuum panels between the second and third channels spaced apart from each other, wherein each vacuum panel includes an inwardly offset peripheral portion and a central portion and wherein said container is a hot fill container and is round.

14. A container according to claim 13, wherein the diameter of the container is smaller at the central channel than at the upper and lower channels.

15. A hollow plastic container, which comprises:

a hollow body of plastic material having a lower supporting base, a side wall extending upwardly from the base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel; and six spaced apart vacuum panels between the first and second channels spaced apart from each other, and six spaced apart vacuum panels between the second and third channels spaced apart from each other, wherein each vacuum panel includes an inwardly offset peripheral portion and a central portion, and wherein said container is a hot fill container.

16. A hollow plastic container, which comprises:

a hollow body of plastic material having a lower supporting base, a side wall extending upwardly from the lower base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel, wherein the central channel has a larger diameter than the upper and lower channels; and two to six spaced apart vacuum panels between the first and second channels spaced apart from each other, and two to six spaced part vacuum panels between the second and third channels spaced apart from each other, wherein each vacuum panel includes an inwardly offset peripheral portion and a central portion, and wherein said container is a hot fill container.

17. A hollow plastic container, which comprises:

a hollow body of plastic material having a lower supporting base, a side wall extending upwardly from the lower base, and an upper portion extending upwardly from the side wall, said upper portion including at least one opening therein;

at least three inwardly depressed channels spaced from each other extending around the side wall, with a first of said channels being an upper channel, a second of said channels being a central channel, and a third of said channels being a lower channel, wherein the first and third of said channels each include at least two spaced apart discontinuities comprising raised portions, each of which interrupts the continuity of said first and third channels, wherein the central channel is continuous; and two to six spaced apart vacuum panels between the first and second channels spaced apart from each other, and two to six spaced apart vacuum panels between the second and third channels spaced apart from each other, wherein each vacuum panel includes an inwardly offset peripheral portion and a central portion, and wherein said container is a hot fill container.

* * * * *